US008398008B2

(12) United States Patent
Guerrero Palma

(10) Patent No.: US 8,398,008 B2
(45) Date of Patent: Mar. 19, 2013

(54) FORCE TRANSFER SYSTEM COMPRISING A HYDRAULIC CYLINDER AND A THRUST BEARING

(75) Inventor: Pedro Guerrero Palma, Lippetal (DE)

(73) Assignee: Polysius AG, Beckum (DE)

( * ) Notice: Subject to any disclaimer, the term of this patent is extended or adjusted under 35 U.S.C. 154(b) by 254 days.

(21) Appl. No.: 12/918,229

(22) PCT Filed: Feb. 19, 2009

(86) PCT No.: PCT/EP2009/051977

§ 371 (c)(1),
(2), (4) Date: Aug. 18, 2010

(87) PCT Pub. No.: WO2009/103762

PCT Pub. Date: Aug. 27, 2009

(65) Prior Publication Data

US 2011/0006144 A1 Jan. 13, 2011

(30) Foreign Application Priority Data

Feb. 22, 2008 (DE) ..... 10 2008 010 652

(51) Int. Cl.
*B02C 4/32* (2006.01)

(52) U.S. Cl. ..... 241/121; 92/215; 92/255

(58) Field of Classification Search ..... 241/117–121; 92/216, 255
See application file for complete search history.

(56) References Cited

U.S. PATENT DOCUMENTS

| | | | | |
|---|---|---|---|---|
| 4,909,450 | A * | 3/1990 | Henne et al. | 241/119 |
| 5,099,750 | A * | 3/1992 | Rebel | 92/12.2 |
| 6,092,457 | A * | 7/2000 | Inoue et al. | 92/129 |

FOREIGN PATENT DOCUMENTS

| | | | |
|---|---|---|---|
| EP | 0294609 | A2 | 12/1988 |
| EP | 0341390 | A2 | 11/1989 |
| EP | 0896151 | A2 | 2/1999 |
| JP | 2000312832 | A | 11/2000 |

* cited by examiner

*Primary Examiner* — Mark Rosenbaum
(74) *Attorney, Agent, or Firm* — Gifford, Krass, Sprinkle, Anderson & Citkowski, P.C.

(57) ABSTRACT

The invention relates to a force transfer system comprising a hydraulic cylinder (1) comprising a piston (10) which can be impinged with hydraulic fluid and a thrust bearing (2) which is in operative contact with the piston, said bearing comprising a first and a second glide surface for exerting a sliding motion. The thrust bearing comprises a pressure space (25) which is connected to the side of the piston (10) impinged with hydraulic fluid by way of at least one hole (11) made in the piston.

20 Claims, 4 Drawing Sheets

FORCE TRANSFER SYSTEM COMPRISING A HYDRAULIC CYLINDER AND A THRUST BEARING

The invention relates to a force transfer system having a hydraulic cylinder, which comprises a piston pressurisable by hydraulic fluid, and a thrust bearing in operative contact with the piston, which thrust bearing comprises a first and a second slide face for performing a sliding motion.

Such a force transfer system is used, for example, in roller mills having at least one grinding roller and a rotatable grinding table as well as an arm applying grinding force, the arm applying grinding force being retained so as to be pivotally movable and rotationally secure in a bearing, and the grinding roller being supported rotatably at the other end of the arm applying grinding force. Such a roller mill is known for example, from JP-A-2000312832. The force transfer system serves in that case to exert a force on the arm applying grinding force, which then presses the grinding roller onto the grinding table. At the same time, the arm applying grinding force executes a pivoting movement, so that high transverse forces occur in the region of the force transfer system.

The invention therefore addresses the problem of specifying a force transfer system that is distinguished by markedly reduced transverse forces.

According to the invention, this problem is solved by the features of claim 1.

The force transfer system according to the invention substantially comprises a hydraulic cylinder, which comprises a piston pressurisable with hydraulic fluid, and a thrust bearing that is in operative contact with the piston and has at least a first and a second slide face for performing a sliding motion. The thrust bearing further provides a pressure chamber, which is connected by way of at least one bore formed in the piston to the side of the piston pressurised with hydraulic fluid.

Because of the pressure chamber, a marked relief of load occurs in the region of the slide faces and the transverse forces acting on the piston are also reduced. Depending on the dimensions of the pressure chamber, it would be possible to achieve reductions in the transverse forces in the range of from 80 to 95% and more.

Further constructions of the invention are the subject matter of the subsidiary claims.

According to a preferred construction of the invention, the thrust bearing is connected to the hydraulic cylinder by way of a coupling rod, the coupling rod being mounted in an articulated manner in order to permit the sliding motion of the thrust bearing. This coupling rod ensures that the hydraulic cylinder and the thrust bearing are cohesive even when, during dynamic processes, differences in pressure occur between the individual operative faces. The coupling rod preferably runs through the bore of the piston and is supported at the end face of the piston remote from the thrust bearing.

Depending on the purpose of the force transfer system, apart from the first and second slide faces, a third and fourth slide face can be provided to perform a pivoting motion. Here, the first and second slide faces of the thrust bearing can be oriented, for example, flush with respectively transverse to the direction of movement of the piston, whilst the third or fourth slide face of the thrust bearing is of convex or spherical form and the other slide face is in the form of a complementary mating face.

A thrust bearing having four slide faces preferably comprises the following components:

a. a first thrust element, one side of which is in operative connection with the piston and the other side of which forms the first slide face, b. a second thrust element, one side of which forms the fourth slide face and the other side of which serves for the force transfer, as well as c. an intermediate element, one side of which forms the second slide face and acts as mating face to the first slide face and the other side of which forms the third slide face and acts as mating face to the fourth slide face.

Because the hydraulic fluid acts via the bore on the pressure chamber, seals are provided between respective associated slide faces, that is, between the first and second and the third and fourth slide faces and the pressure building up in the pressure chamber causes the associated slide faces and the piston to be relieved of pressure. It is therefore desirable to select the pressure-loaded areas in the pressure chamber produced by the seals to be preferably between 80 and 95% of the piston area. The effective transverse forces in the region of the slide faces and the piston are thus reduced by this percentage. It is, of course, also conceivable for the pressure-loaded areas to be made larger than the piston area. But the result of this would be that the thrust bearing would lift and float, so that the piston rod would have to be correspondingly biased.

The marked reduction in transverse forces also has the advantage that the unit comprising hydraulic cylinder and thrust bearing can be made substantially more compact. A reduction in the overall size by 30% is not impossible here. This also leads to a clear reduction in the costs of the thrust bearing.

Further advantages and embodiments of the invention are explained in detail hereafter with the help of the description and the drawings, in which.

Figure 1:
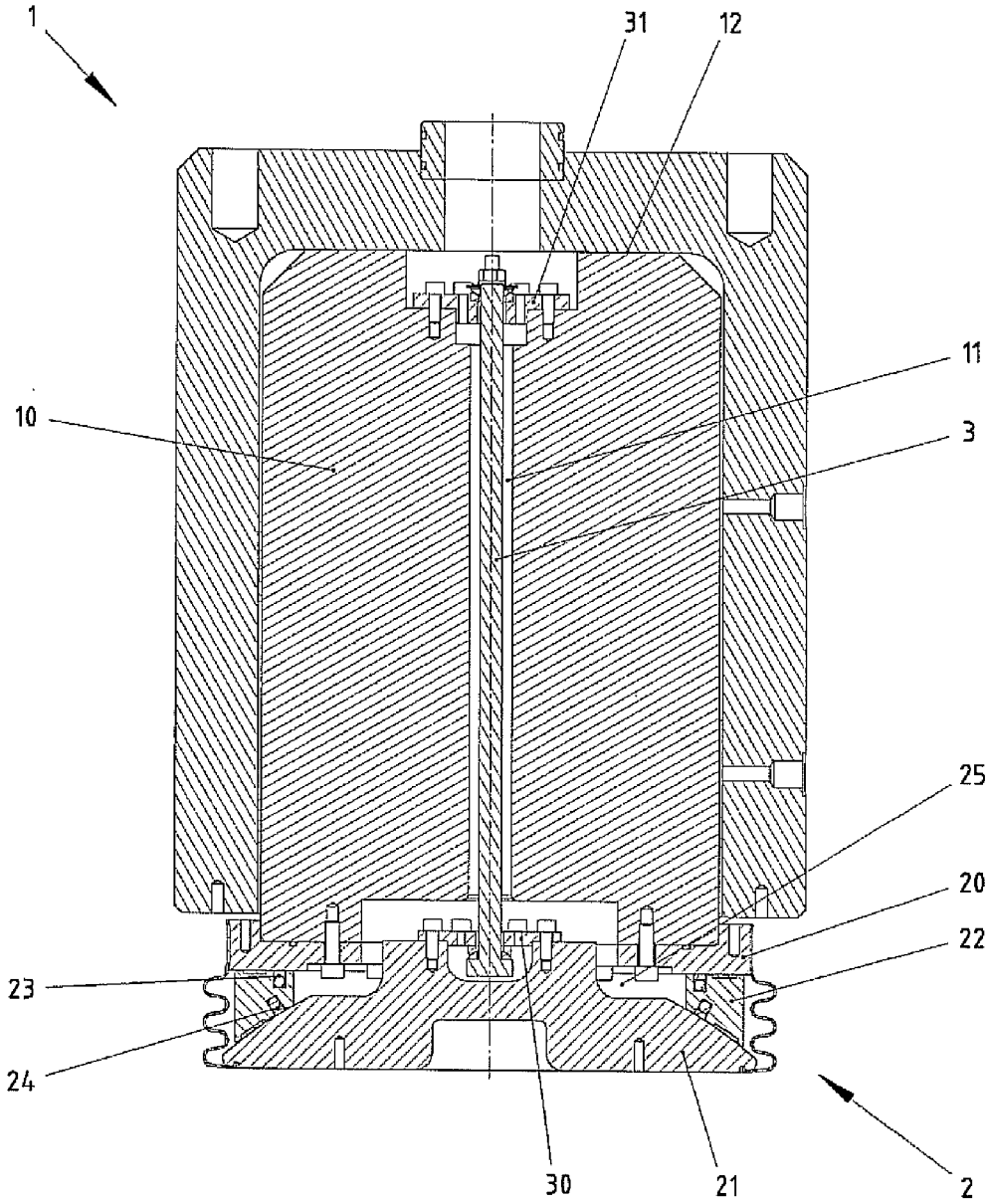
FIG. 1 shows a sectional view of the force transfer system.
Figure 2:
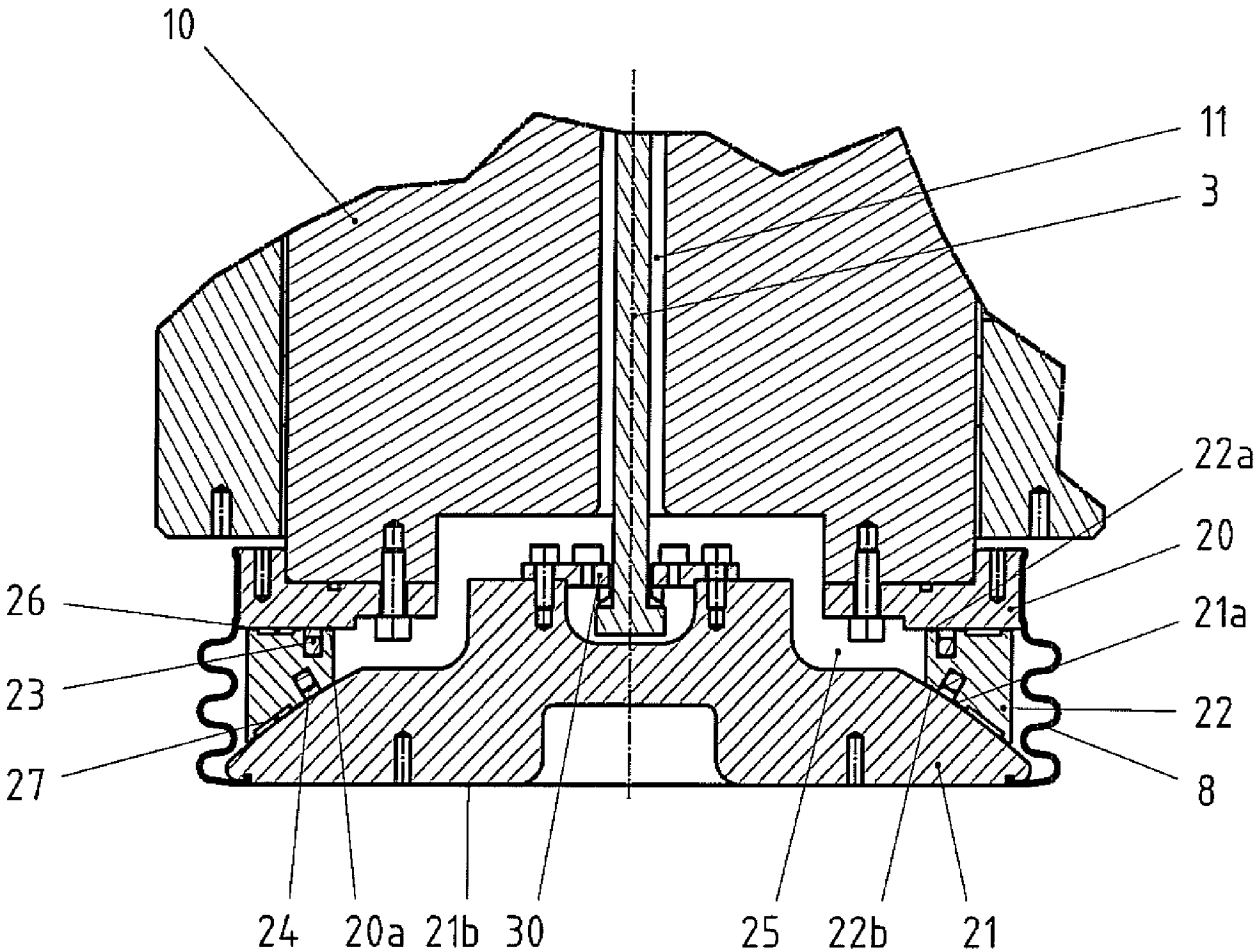
FIG. 2 shows a sectional partial view of the force transfer system in the region of the thrust bearing.

The force transfer system shown in FIGS. 1 and 2 substantially comprises a hydraulic cylinder 1, which comprises a piston 10 pressurisable with hydraulic fluid, and a thrust bearing 2 in operative contact with the piston.

The thrust bearing comprises substantially the following components:

a. a first thrust element 20, which is fastened with one side to the lower end face of the piston 10 and the other side of which forms a first slide face 20*a*, b. a second thrust element 21, one side of which forms a fourth slide face 21*a* and the other side 21*b* of which serves to transfer force, and also c. an intermediate element 22, one side of which forms the second slide face 22*a*, which acts a mating face to the first slide face 20*a*, and the other side of which forms a third slide face 22*b*, which acts a mating face to the fourth slide face 21*a*.

Furthermore, a first seal 23 is provided between the first and second slide faces 20*a*, 22*a* and a second seal 24 is provided between the third and the fourth slide faces 22*b*, 21*a*. In the region of the thrust bearing 2 a pressure chamber 25 is therefore formed, which is bounded by the first and second thrust elements 20, 21, the intermediate element 22 and a part of the end face of the piston 10 facing towards the thrust bearing. Sealing towards the outside in the region of the slide faces is effected by means of the seals 23, 24.

The pressure chamber 25 communicates via one or more bores 11 formed in the piston with the side of the piston 10 on which hydraulic fluid acts. In this way, hydraulic fluid enters the pressure chamber 25 and there causes the first and second thrust elements 20, 21 to be pressed apart, the result being that the pressure acting on the slide faces is reduced corresponding to the effective pressure-loaded areas. The effective pressure-loaded areas are formed by the diameter (d) of the annular seals 23 and 24 according to the formula $(d/2)^2*\pi$.

To ensure the cohesion of hydraulic cylinder 1 and thrust bearing 2, a coupling rod 3 is moreover provided, which connects the thrust bearing 2 and with the hydraulic cylinder 1, the coupling rod being mounted in an articulated manner both in the region of the thrust bearing and in the region of the piston, in order to ensure the sliding motion of the thrust bearing in the region of the first and second slide faces and the third and fourth slide faces respectively. As is especially apparent from FIG. 1, in the region of the thrust bearing the coupling rod 3 is retained in an articulated manner at the second thrust element 21 via a bearing 30 and in the region of the end face 12 of the piston remote from the thrust bearing 2 in a bearing 31.

The first and second slide faces 20*a*, 22*a* are oriented transversely to the direction of movement of the piston and form a level slide face. Of the third and fourth slide faces 22*b*, 21*a*, one slide face is convex or spherical and the other slide face is in the form of a correspondingly complementary slide face. The third and fourth slide faces thus enable the thrust bearing to perform a pivoting movement. At the same time, the pivoting radius of the thrust bearing is adapted to the pivoting motion of the arm applying grinding force connected to the force transfer system.

In order to reduce as far as possible the transverse forces acting in the region of the slide faces and in the region of the piston, the pressure-loaded areas defined by the seals 23, 24 should preferably amount to 80 to 95% of the cross-sectional area of the piston 10. The transverse forces are then reduced to a corresponding extent, so that the slide faces are pressurised only with 5 to 20% of the pressure. A certain amount of pressure in the region of the slide faces appears helpful, so that the thrust bearing does not lift up and float. In addition, the egress of hydraulic fluid can then be more easily avoided. If the piston rod 3 is biased, however, by drawing the thrust bearing 2 towards the piston 10, the pressure-loaded areas formed by the seals 23, 24 could amount to up to 100 percent or more of the cross-sectional area of the piston. In the case of the trials forming the basis of the invention however, a value of the pressure-loaded areas formed by the seals 23, 24 in the range from 75 to 99%, preferably between 80 and 95%, proved ideal for highly dynamic applications.

The residual pressure with which the slide faces are pressed against one another is advantageously transferred by way of guide or support rings 26, 27, which are distinguished by an especially low coefficient of friction. The support ring 26 is therefore arranged between the first and second slide faces 20*a*, 22*a* outside the seal 23. The support ring 27 is positioned correspondingly outside the seal 24, between the third and fourth slide faces 22*b* and 21*a*.

Although the above-described thrust bearing 2 has four slide face areas, it is, of course, also conceivable for just two slide faces, for example, the first and second or the third and fourth slide faces to be provided.

The thrust bearing is moreover surrounded by an outer wall 8, which is sufficiently flexible that it does not impede the movement of the thrust bearing. This outer wall can additionally comprise a leakage connection, to return escaping hydraulic fluid to the reservoir.

Figure 3:
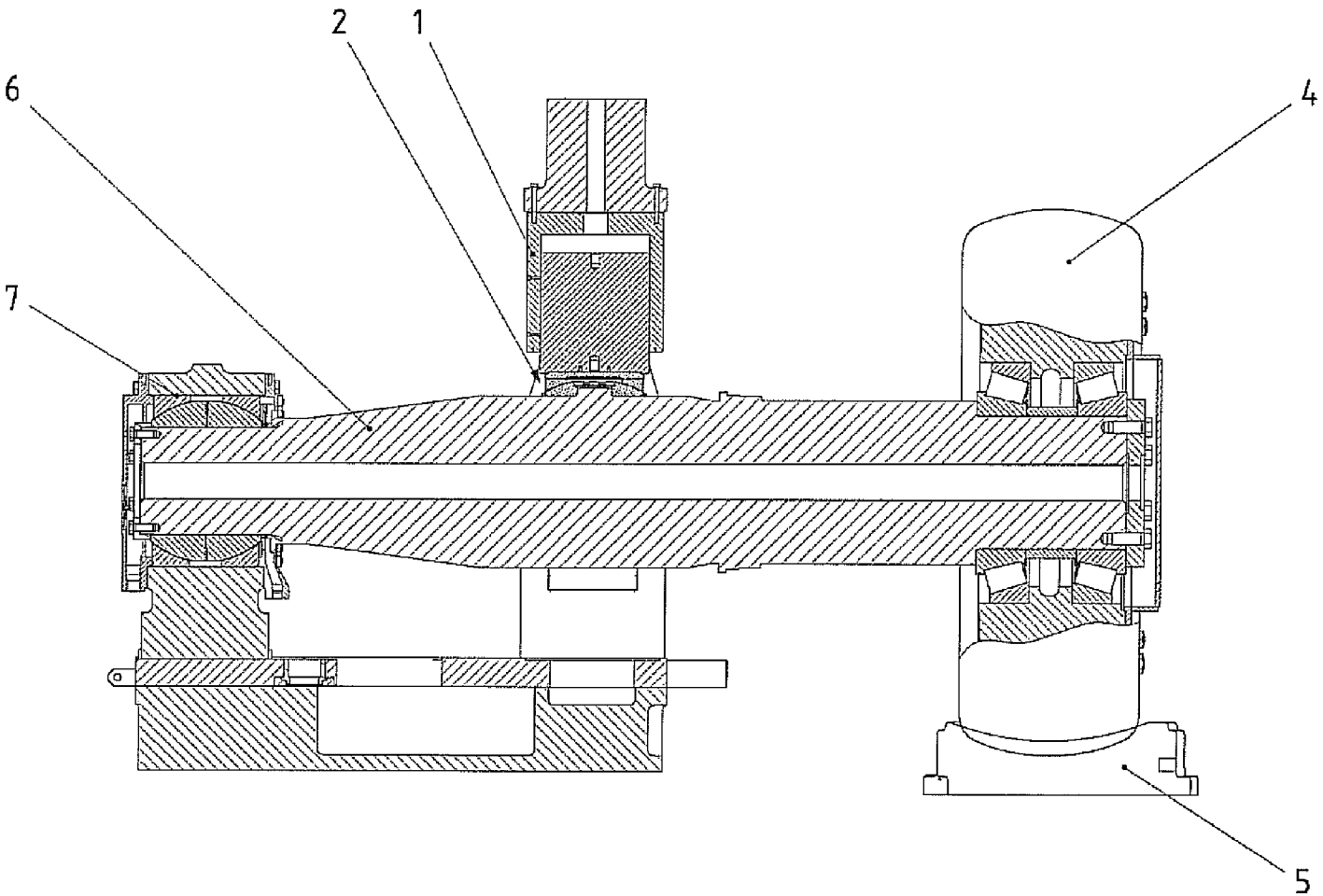
FIG. 3 shows a sectional detailed view of a roller mill and FIG. 4 shows a sectional plan view of a roller press.

A specific example of application for the above-described force transfer system from its use in a roller mill will be described in detail hereafter by means of FIG. 3. The roller mill illustrated schematically in FIG. 3 substantially comprises a grinding roller 4 and a rotatable grinding plate 5. Furthermore, an arm applying grinding force 6 is provided, which is retained so as to be pivotally movable and rotationally secure in a bearing 7 in the form of a fixed bearing, the grinding roller 4 being rotatably mounted at the opposite end of the arm applying grinding force. In addition, a force transfer system according to the above description is provided, which acts with its hydraulic cylinder 1 and its thrust bearing 2 on the arm applying grinding force 6 in a middle region of the same.

To adjust the pressure exerted by the grinding roller 4 on the grinding table 5, the hydraulic cylinder 1 is loaded by a corresponding hydraulic pressure. The pivoting motion of the arm applying grinding force 6 is compensated by the thrust bearing 2, so that the hydraulic cylinder 1 can be fixedly arranged. A plunger cylinder is especially suitable for the hydraulic cylinder, as is also illustrated in FIGS. 1 and 2.

In the exemplary embodiment illustrated, the force transfer system acts in a middle region between the grinding roller 4 and the bearing 7 on the arm applying grinding force 6. In the context of the invention, however, it would also be conceivable for the positions of the bearing and the force transfer system to be transposed.

Figure 4:
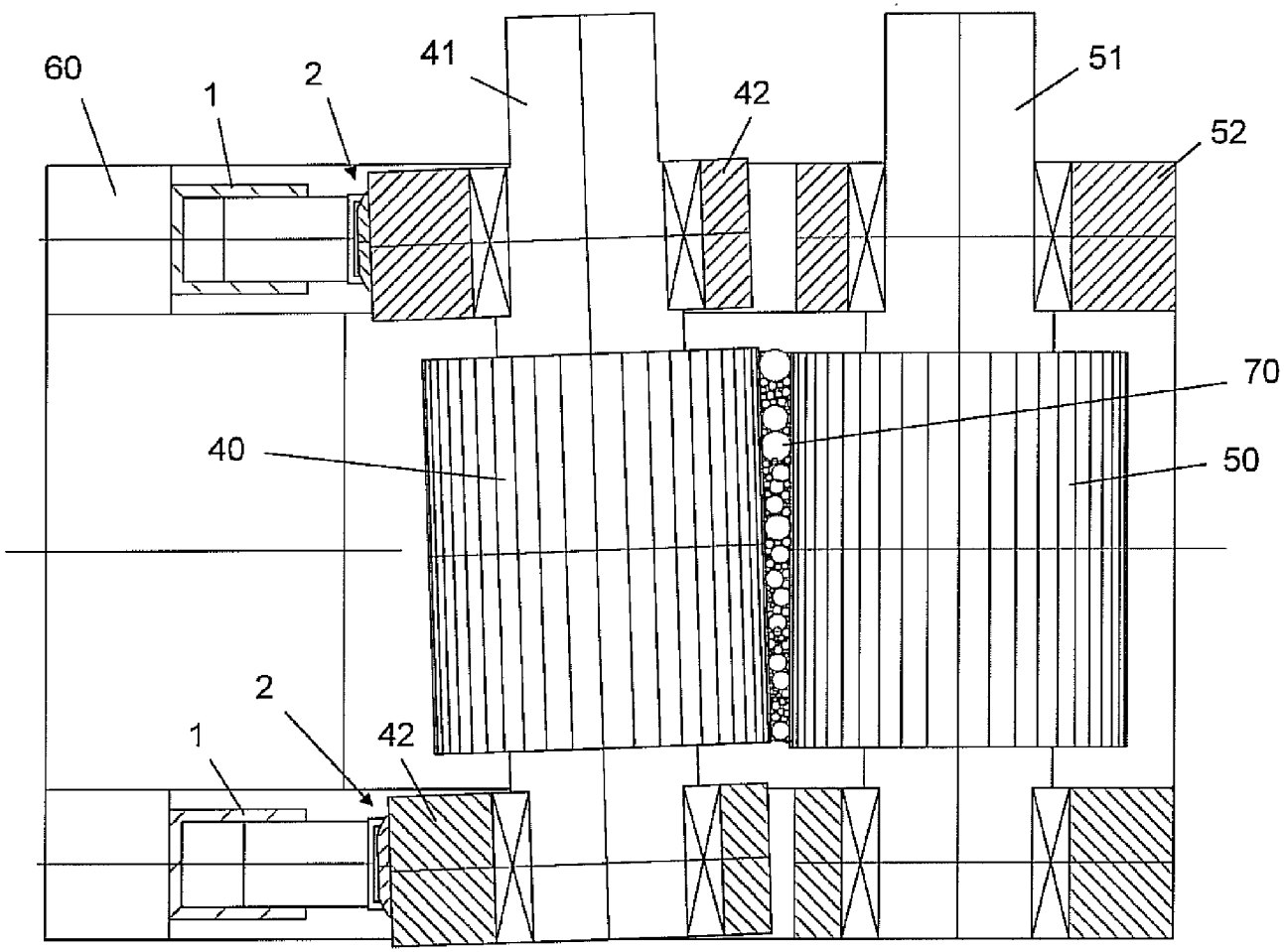

A further exemplary embodiment is shown in FIG. 4 and represents a roller press having two grinding rollers 40, 50 driven in opposite directions. The grinding roller 50 is mounted with a grinding roller axle 51 in a fixed bearing 52, whilst the grinding roller 40 is mounted with its grinding roller axle 41 in a floating bearing 42. The grinding material 70 to be comminuted is fed into the gap formed between the grinding rollers 40, 50 and is comminuted between the rollers.

Furthermore, a force transfer system according to the above description is provided, which is supported with its hydraulic cylinder 1 on a force frame 60 and with its thrust bearing 2 is in operative contact with the floating bearing 42. In the exemplary embodiment illustrated, the grinding roller axles are each mounted in two bearings, so that two force transfer systems are also provided. The force transfer system in a roller press is therefore also suitable for compensating for any skewing of the two grinding rollers that may ensue during operation.

Using the above-described force transfer system, the transverse forces in the region of the slide faces and the transverse forces acting on the piston can be clearly reduced. Depending on the design of the pressure-loaded areas in the pressure chamber, the transverse forces amount to just 20% to 5% or less than the original transverse forces.

The hydraulic cylinder and the thrust bearing can therefore be configured for the reduced transverse forces, whereby construction can be more compact and the costs for manufacture can be reduced.

The invention claimed is:

1. A force transfer system comprising;

a hydraulic cylinder having a piston pressurisable by hydraulic fluid;

a thrust bearing in operative contact with the piston, the thrust bearing having at least a first and a second slide face for performing a sliding motion, a coupling rod, which connects the thrust bearing with the hydraulic cylinder, the coupling rod being mounted in an articulated manner in order to permit the sliding motion of the thrust bearing, the thrust bearing having a pressure chamber, which is connected by way of at least one bore formed in the piston to the side of the piston pressurized with hydraulic fluid, the thrust bearing having a first thrust element having one side in operative connection with the piston and another side forming a first slide face, a second thrust element having one side forming a fourth slide face and another side for force transfer, and an intermediate element having one side forming the second slide face and acts as mating face to the first slide face and another side forming a third slide face and acts as mating face to the fourth slide face.

2. A force transfer system according to claim 1, comprising the coupling rod extending through a bore of the piston and being retained at the end face of the piston remote from the thrust bearing.

3. A force transfer system according to claim 1, comprising the third and a fourth slide faces being configured for a pivoting motion.

4. A force transfer system according to claim 1, comprising the first and second slide faces of the thrust bearing are of flat construction.

5. A force transfer system according to claim 1, comprising the first and second slide faces of the thrust bearing are oriented transversely to the direction of movement of the piston.

6. A force transfer system according to claim 1, comprising the third or fourth slide face of the thrust bearing is of convex or spherical form and the other slide face is in the form of a complementary mating face.

7. A force transfer system according to claim 1, comprising a first seal is provided between the first and second slide faces of the thrust bearing.

8. A force transfer system according to claim 1, comprising a support ring for mechanical force transfer being provided between the first and second slide faces of the thrust bearing.

9. A force transfer system according to claim 1, comprising the coupling rod being mounted in an articulated manner at the second thrust element in the region of the thrust bearing.

10. A roller mill having at least one grinding roller and at a rotatable grinding table, an arm applying grinding force that is retained so as to be pivotally movable and rotationally secure in a bearing, wherein the grinding roller is rotatably mounted at one end of the arm applying grinding force, and having a for exerting a force on the arm applying grinding force the comprising a hydraulic cylinder having a piston pressurisable by hydraulic fluid, a thrust bearing in operative contact with the piston, the thrust bearing having at least a first and a second slide face for performing a sliding motion, a coupling rod, which connects the thrust bearing with the hydraulic cylinder, the coupling rod being mounted in an articulated manner in order to permit the sliding motion of the thrust bearing, the thrust bearing having a pressure chamber, which is connected by way of at least one bore formed in the piston to the side of the piston pressurised with hydraulic fluid, the thrust bearing having a first thrust element having one side in operative connection with the piston and another side forming a first slide face, a second thrust element having one side forming a fourth slide face and another side for force transfer, and an intermediate element having one side forming the second slide face and acts as mating face to the first slide face and another side forming a third slide face and acts as mating face to the fourth slide face.

11. A roller mill according to claim 10, comprising the coupling rod extending through a bore of the piston and being retained at the end face of the piston remote from the thrust bearing.

12. A roller mill according to claim 10, comprising the third and a fourth slide faces being configured for a pivoting motion.

13. A roller mill according to claim 10, comprising the first and second slide faces of the thrust bearing are of flat construction.

14. A roller mill according to claim 10, comprising the first and second slide faces of the thrust bearing are oriented transversely to the direction of movement of the piston.

15. A roller press having two grinding rollers driven in opposite directions and a for exerting a force on at least one of the grinding rollers, the comprising a hydraulic cylinder having a piston pressurisable by hydraulic fluid, a thrust bearing in operative contact with the piston, the thrust bearing having at least a first and a second slide face for performing a sliding motion, a coupling rod, which connects the thrust bearing with the hydraulic cylinder, the coupling rod being mounted in an articulated manner in order to permit the sliding motion of the thrust bearing, the thrust bearing having a pressure chamber, which is connected by way of at least one bore formed in the piston to the side of the piston pressurised with hydraulic fluid, the thrust bearing having a first thrust element having one side in operative connection with the piston and another side forming a first slide face, a second thrust element having one side forming a fourth slide face and another side for force transfer, and an intermediate element having one side forming the second slide face and acts as mating face to the first slide face and another side forming a third slide face and acts as mating face to the fourth slide face.

16. A roller press according to claim 15, comprising the coupling rod extending through a bore of the piston and being retained at the end face of the piston remote from the thrust bearing.

17. A roller press according to claim 15, comprising the third and a fourth slide faces being configured for a pivoting motion.

18. A roller press according to claim 15, comprising the first and second slide faces of the thrust bearing are of flat construction.

19. A roller press according to claim 15, comprising the first and second slide faces of the thrust bearing are oriented transversely to the direction of movement of the piston.

20. A roller press according to claim 15, comprising the third or fourth slide face of the thrust bearing is of convex or spherical form and the other slide face is in the form of a complementary mating face.

* * * * *

UNITED STATES PATENT AND TRADEMARK OFFICE

CERTIFICATE OF CORRECTION

PATENT NO. : 8,398,008 B2
APPLICATION NO. : 12/918229
DATED : March 19, 2013
INVENTOR(S) : Pedro Guerrero Palma It is certified that error appears in the above-identified patent and that said Letters Patent is hereby corrected as shown below:

In the Claims

Column 6, claim 15, line 18, the words --force transfer system-- should be inserted between the words “a” and “for”.

Column 6, claim 15, line 19, the words --force transfer system-- should be inserted between the words “the” and “comprising”.

Signed and Sealed this
Twenty-ninth Day of April, 2014

Michelle K. Lee

Michelle K. Lee
*Deputy Director of the United States Patent and Trademark Office*